US011208818B1

(12) United States Patent
Pulizzi et al.

(10) Patent No.: US 11,208,818 B1
(45) Date of Patent: Dec. 28, 2021

(54) SAFETY APPARATUS

(71) Applicants: Peter Pulizzi, Temecula, CA (US); Raymond Feith, Chino Hills, CA (US)

(72) Inventors: Peter Pulizzi, Temecula, CA (US); Raymond Feith, Chino Hills, CA (US)

( * ) Notice: Subject to any disclaimer, the term of this patent is extended or adjusted under 35 U.S.C. 154(b) by 0 days.

(21) Appl. No.: 16/934,569

(22) Filed: Jul. 21, 2020

Related U.S. Application Data

(63) Continuation-in-part of application No. 16/795,476, filed on Feb. 19, 2020, now Pat. No. 10,760,294.

(51) Int. Cl.

| | |
|---|---|
| ***E04G 21/32*** | (2006.01) |
| ***E04H 12/22*** | (2006.01) |
| ***E04C 5/16*** | (2006.01) |
| *E04H 17/00* | (2006.01) |

(52) U.S. Cl.
CPC ..... *E04G 21/3252* (2013.01); *E04C 5/161* (2013.01); *E04H 12/22* (2013.01); *E04H 12/2292* (2013.01); *E04H 17/006* (2021.01)

(58) Field of Classification Search
CPC ..... E04H 12/00; E04H 12/22; E04H 12/2292; E04H 17/20; E04H 17/22; E04H 2017/006; G09F 7/10; Y10T 29/53657; E04G 21/3252; E04C 5/161
See application file for complete search history.

(56) References Cited

U.S. PATENT DOCUMENTS 1,444,834 A * 2/1923 Hindmarsh ..... E02D 13/10 173/130
2,450,345 A * 9/1948 Kervin ..... A01G 17/14 52/301
2,723,107 A * 11/1955 Parker ..... E04H 17/20 256/24
3,131,792 A * 5/1964 Groneman ..... A47F 11/02 52/38
3,250,050 A * 5/1966 Finger ..... E04H 12/00 52/301
3,267,805 A * 8/1966 Ackerman ..... E01F 9/619 359/538
3,319,328 A * 5/1967 Finger ..... H02G 7/00 29/423
3,955,801 A * 5/1976 Soriero, Jr. ..... E04H 17/1413 256/65.13

(Continued)

*Primary Examiner* — Jessie T Fonseca
(74) *Attorney, Agent, or Firm* — Gulf Coast Intellectual Property Group

(57) ABSTRACT

A safety cover configured to be releasably secured to an exposed portion of a construction element so as to provide improved visibility thereof and provide impalement protection. The safety cover includes a body having an upper portion and a lower portion. The upper portion and lower portion of the body are integrally formed wherein the lower portion of the body extends downward from the lower surface of the upper portion. In one embodiment the upper portion includes a central support member having a curved portion with an upper impact rib structure. The curve portion further has a second rib formation opposite the upper impacts rib structure wherein the second rib formation extends downward into the lower portion. A support collar is disposed in the lower portion and is configured to engage a metal stake or bar. An impact layer can further be present in the upper portion.

7 Claims, 4 Drawing Sheets

(56) References Cited

U.S. PATENT DOCUMENTS 4,369,953 A * 1/1983 Greiner ..... E04H 17/166 256/24
4,516,756 A * 5/1985 Beatty ..... E04H 17/06 256/1
5,085,409 A * 2/1992 Teixeira ..... E04H 17/12 174/158 F
5,299,883 A * 4/1994 Arth, Jr. ..... E01F 15/0469 256/13.1
5,755,431 A * 5/1998 Williams ..... E04H 12/2215 256/19
5,853,167 A * 12/1998 West ..... E04H 17/20 256/66
5,956,875 A * 9/1999 Aughenbaugh ..... G09F 7/10 40/607.03
6,021,614 A * 2/2000 Krieger ..... E04H 12/04 52/301
D465,585 S * 11/2002 Venegas, Jr. ..... D25/126
6,543,750 B1 * 4/2003 Calzone ..... E04H 17/20 256/1
6,612,082 B2 * 9/2003 Schimmelpfennig ... E04C 5/161 248/523
6,612,551 B1 * 9/2003 Roy ..... E04H 17/12 256/1
D563,254 S * 3/2008 Moore ..... D10/111
7,578,099 B2 * 8/2009 Schlegel ..... E04H 12/2292 52/3
2002/0104985 A1 * 8/2002 Lesenskyj ..... E04H 17/1439 256/65.1
2002/0125468 A1 * 9/2002 Fischer ..... E04H 17/20 256/19
2002/0148183 A1 * 10/2002 Grant ..... F21S 8/081 52/300
2003/0066992 A1 * 4/2003 Burkart ..... E04H 17/20 256/1
2003/0106273 A1 * 6/2003 Neylon ..... E04H 17/20 52/244
2005/0035339 A1 * 2/2005 Steffes ..... E04H 17/20 256/1
2005/0247920 A1 * 11/2005 Burkart ..... F21V 33/006 256/1
2006/0033091 A1 * 2/2006 Fattori ..... B29C 65/08 256/19
2008/0149786 A1 * 6/2008 Bradley ..... F16B 9/054 248/121
2008/0265229 A1 * 10/2008 DiMartino ..... E04H 17/20 256/1
2012/0018692 A1 * 1/2012 Langenwalter ..... E04H 17/1439 256/65.12
2013/0126068 A1 * 5/2013 Fattori ..... B29C 66/534 156/73.1
2015/0137058 A1 * 5/2015 Platt ..... E04H 12/2292 256/65.14
2015/0240515 A1 * 8/2015 Davis ..... A47B 37/04 256/1
2017/0211290 A1 * 7/2017 Lupton ..... E04H 17/161
2018/0245301 A1 * 8/2018 Herdman ..... E04H 17/20
2018/0266119 A1 * 9/2018 Schneider ..... E04F 11/1836
2018/0355632 A1 * 12/2018 Nickelston ..... E04H 17/20
2019/0128016 A1 * 5/2019 Geise ..... E04H 17/20

* cited by examiner

SAFETY APPARATUS

CROSS REFERENCE TO RELATED APPLICATIONS

This application is a continuation-in-part of U.S. patent application Ser. No. 16/795,476 filed, Feb. 19, 2020, entitled, Safety Apparatus, now issued U.S. Pat. No. 10,760,294 in the name of Peter Pulizzi, which is hereby incorporated for reference.

FIELD OF THE INVENTION

The present invention relates generally to safety apparatus, more specifically but not by way of limitation, a protective implement utilized in the field of construction wherein the protective implement is operable to be releasably secured to an exposed portion of a stake or similar item that presents a safety hazard and is either required or desirable to provide coverage thereof so as to prevent injuries to individuals proximate thereto.

BACKGROUND

There are numerous types of techniques and projects construction projects which range in scope and scale from a simple remodel of an existing structure to new construction of a commercial facility. Numerous types of construction techniques are employed depending upon parameters such as but not limited to the application and code requirements. Concrete foundations are commonly used in applications that range from additions to facilities or in the construction of large commercial facilities. Foundations are structurally secured to walls and other building elements utilizing various techniques and fasteners. It is necessary to provide a structural bond intermediate the foundation and building support elements such as but not limited to posts. Round stakes such as rebar or metal flat bar are used to provide a structural coupling between the foundation and construction elements such as but not limited to structural columns, walls and similar construction elements. The upper portion is configured to be mechanically coupled to a support post or similar element utilizing suitable durable mechanical techniques.

One issue presented ensuing installation of the aforementioned is the exposure of their upper portion subsequent installation. The exposed upper portions of the rebar or flat bar create significant safety hazards on the construction site for workers traversing thereby. Some construction sites utilize hundreds of these elements and as various trades perform their portion of the construction project, the exposed upper portions present hazards such as but not limited to tripping hazards. Furthermore, these exposed upper portions create safety hazards wherein an individual can suffer from lacerations and impalement and other workplace injuries leading to increased liability for the builder and risk for the workers on the job site.

Accordingly, there is a need for a safety cover for exposed stakes such as but not limited to rebar or flat bar that can be releasably secured thereto and reduce the safety hazard risk inherent in the exposed portion of the aforementioned.

SUMMARY OF THE INVENTION

It is the object of the present invention to provide a safety cover for an exposed construction element wherein the safety cover is configured to be releasably secured to the upper portion of the exposed construction element that includes a body wherein the body has an integrally formed lower portion and upper portion.

Another object of the present invention is to provide a safety cover to prevent injuries on a job site from exposed structural elements wherein the upper portion is perpendicular to the lower portion located at the upper end of the lower portion and further extends outward therefrom.

A further object of the present invention is to provide a safety cover for exposed construction element wherein the safety cover is configured to be releasably secured to the upper portion of the exposed construction element and wherein the lower portion includes a centrally located receiving channel.

Still another object of the present invention is to provide a safety cover to prevent injuries on a job site from exposed construction elements wherein the receiving channel is comprised of a plurality of walls wherein the plurality of walls includes opposing walls having apertures formed therein.

An additional object of the present invention is to provide a safety cover for an exposed construction element wherein the safety cover is configured to be releasably secured to the upper portion of the exposed construction element wherein the body further includes upper portion support members extending outward from the plurality of walls of the lower portion.

Yet a further object of the present invention is to provide a safety cover to prevent injuries on a job site from exposed construction elements wherein one embodiment of the present invention the receiving channel of the lower portion includes a plurality of rib formations proximate the top thereof.

Another object of the present invention is to provide a safety cover for exposed construction elements wherein the safety cover is configured to be releasably secured to an exposed portion of a column base connector wherein the upper portion of one embodiment of the present invention includes a center protective member.

Still a further object of the present invention is to provide a safety cover to prevent injuries on a job site from exposed construction elements wherein rib formations are on opposing sides of support member of the upper portion.

Yet another object of the present invention is to provide a safety cover for exposed construction elements wherein the receiving channel includes engagement members formed therein proximate the upper end thereof.

An additional object of the present invention is to provide a safety cover to prevent injuries on a job site from exposed construction elements wherein the upper portion includes a support member formed therein extending the width thereof.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
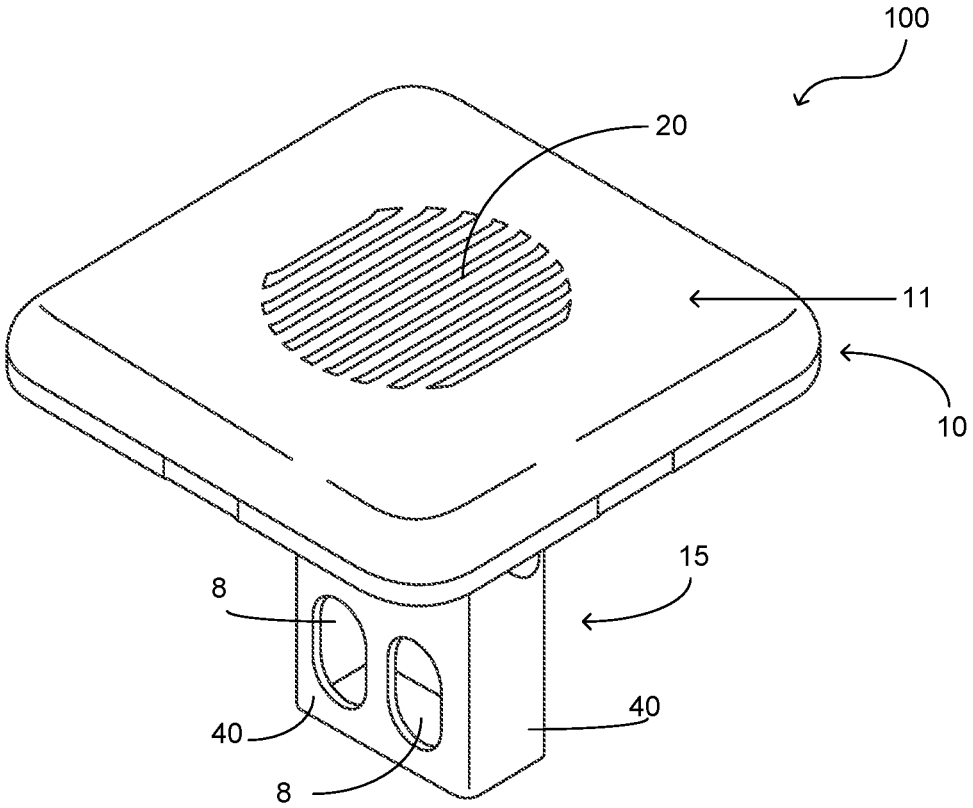
FIG. 1 is a top perspective view of a first embodiment of the present invention.
Figure 2:
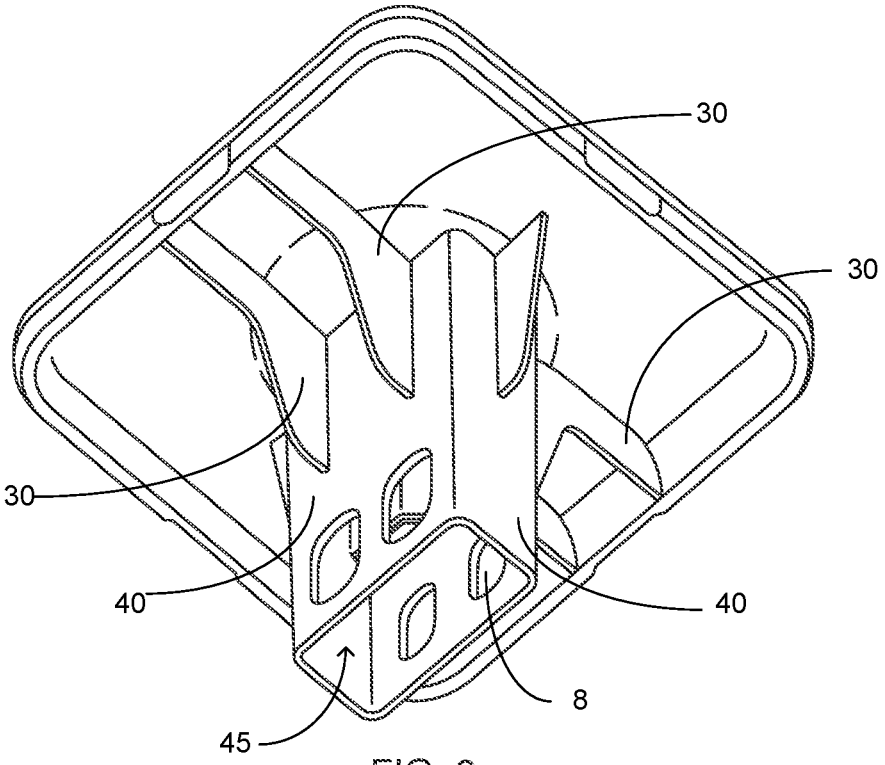
FIG. 2 is a bottom perspective view of the first embodiment.

Referring now to the drawings submitted herewith, wherein various elements depicted therein are not necessarily drawn to scale and wherein through the views and figures like elements are referenced with identical reference numerals, there is illustrated a safety cover 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 3:
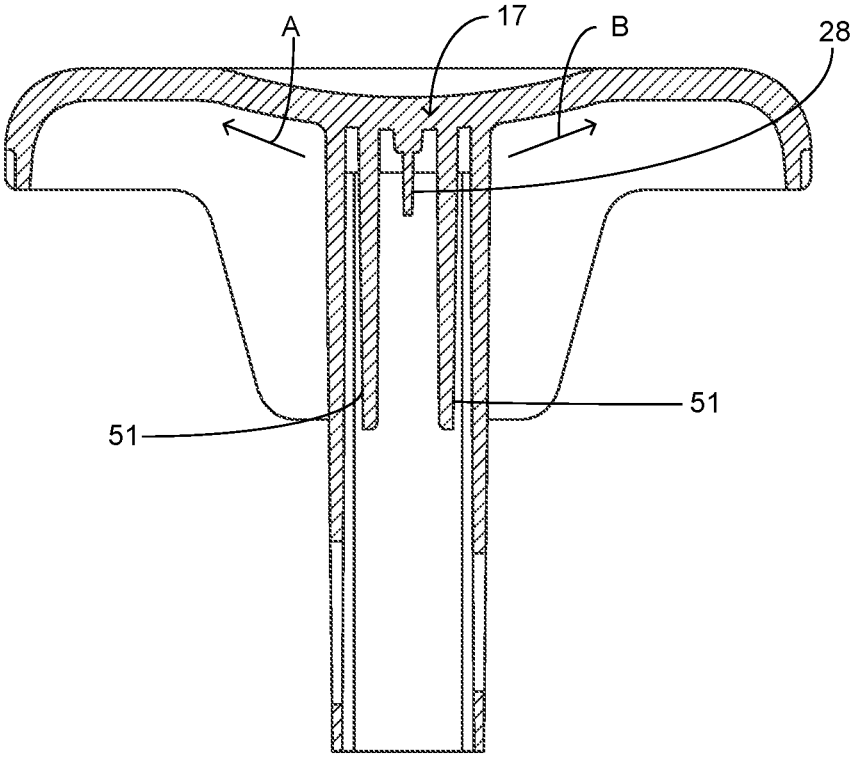
FIG. 3 is a cross-sectional of the first embodiment of the present invention.
Figure 4:
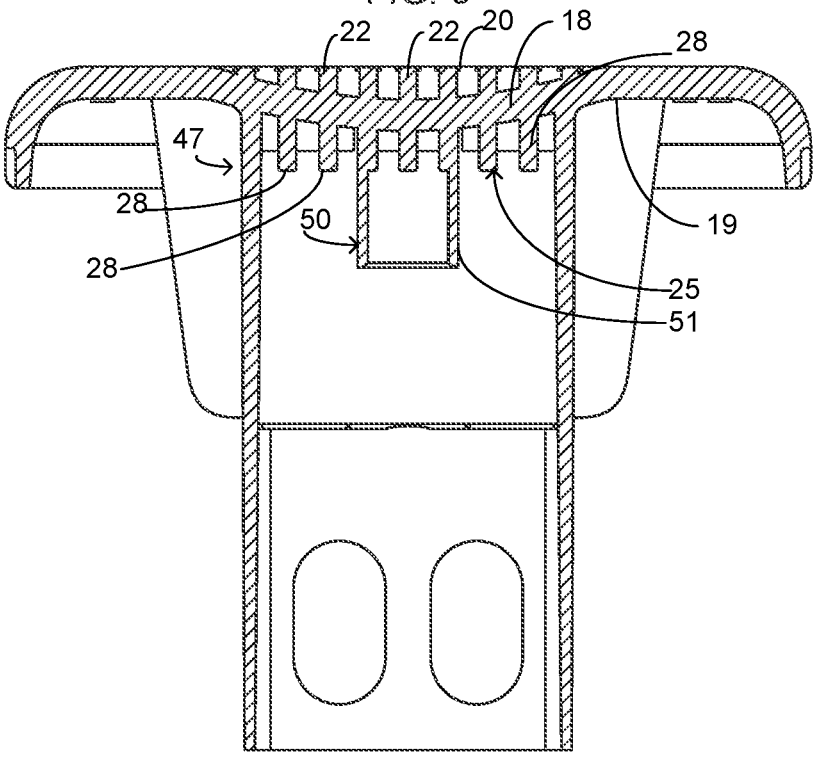
FIG. 4 is side cross sectional of the first embodiment of the present invention.
Figure 5:
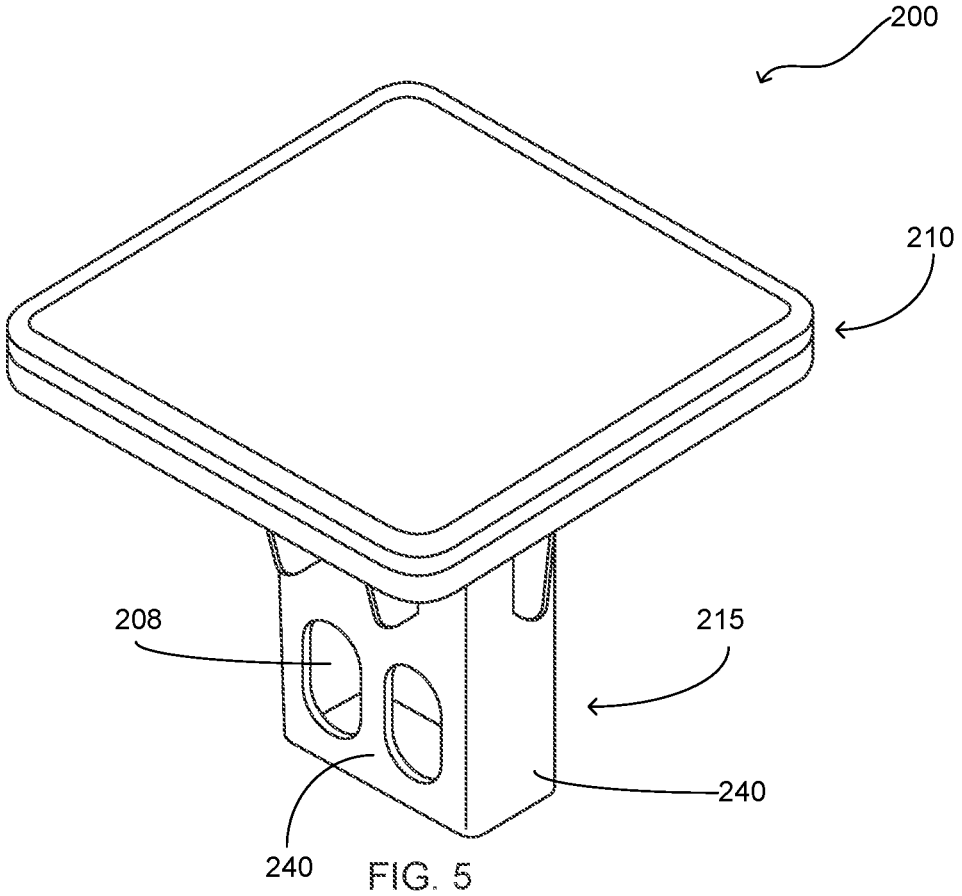
FIG. 5 is a top perspective view of the second embodiment of the present invention.
Figure 6:
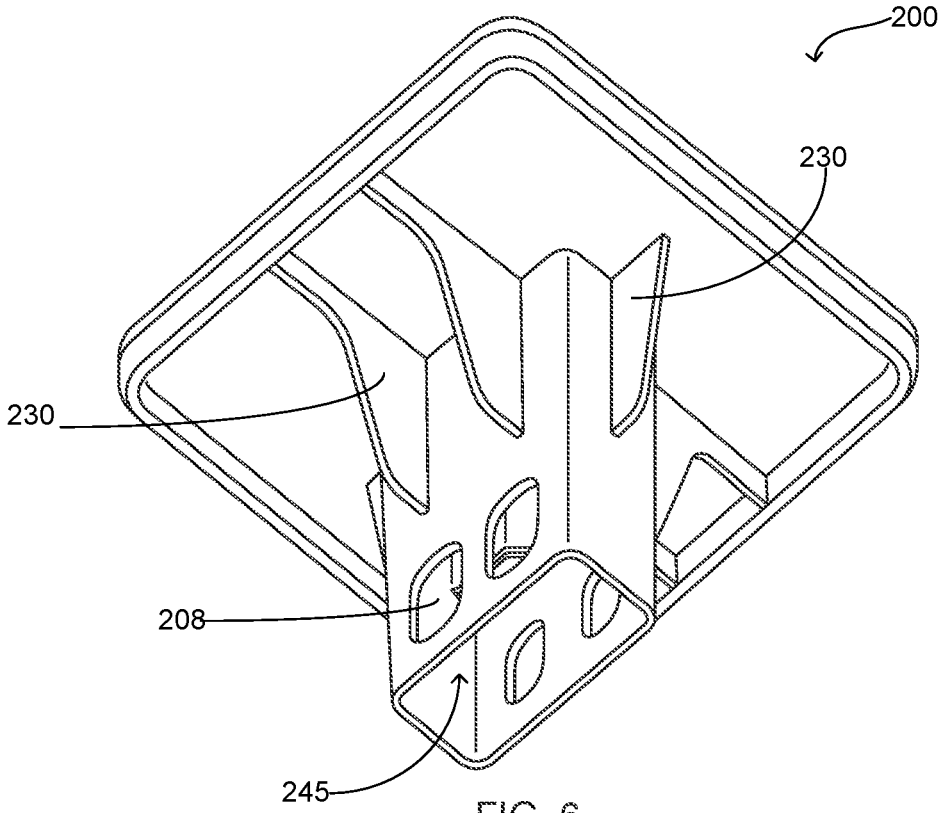
FIG. 6 is a bottom perspective view of the second embodiment of the present invention.
Figure 7:
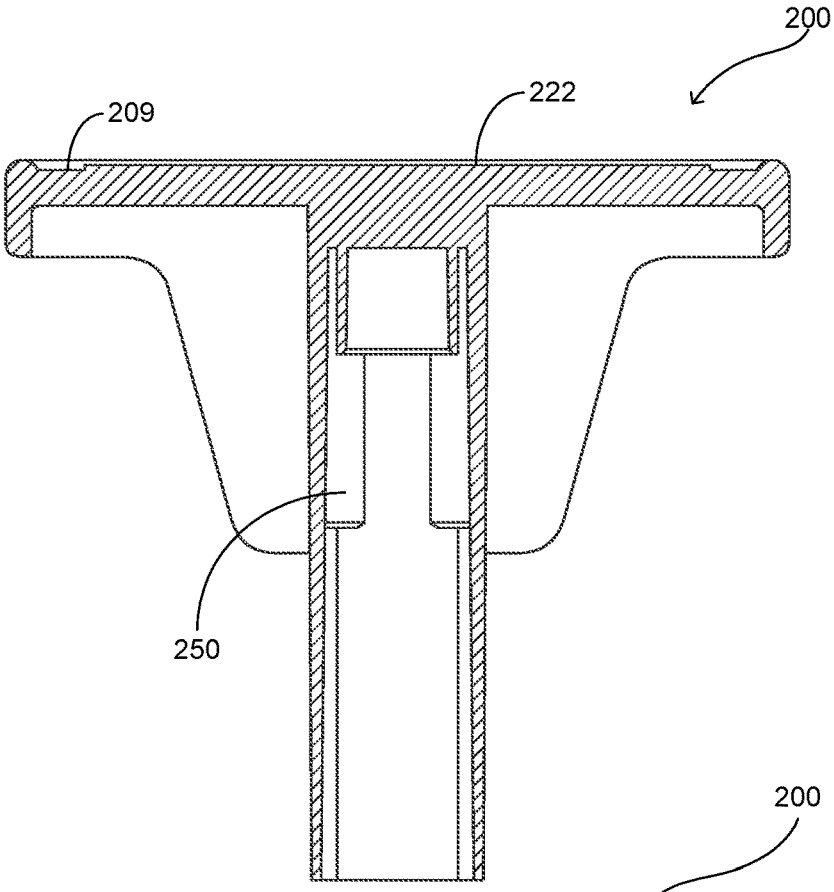
FIG. 7 is a cross-sectional of the second embodiment of the present invention.
Figure 8:
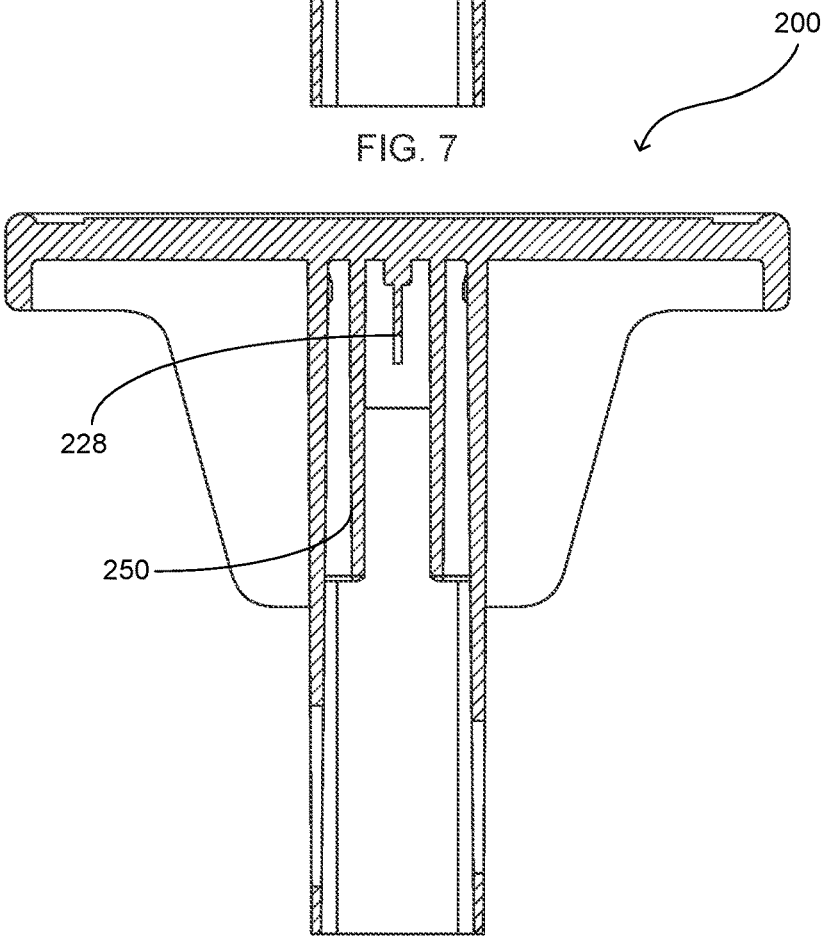
FIG. 8 is a side cross-sectional of the second embodiment of the present invention.

Referring in particular to Figures herein, the safety cover 100 illustrated in FIGS. 1 through 4 herein is a first embodiment of the safety cover 100. The safety cover 100 includes an upper portion 10 contiguously formed with a lower portion 15. The upper portion 10 is planar in manner and square in shape. It should be understood within the scope of the present invention that the upper portion 10 could be formed in alternate shapes and sizes. The upper surface 11 of the upper portion 10 has an upper impact rib structure 20 formed therein. As seen in FIGS. 1 and 4, the upper portion 10 includes a central support member 18. Central support member 18 covers the entire area of the upper portion 10 and works in conjunction with the upper impact rib structure 20 and the lower impact rib structure 25 to distribute the force of an impact that is received on the upper portion 10 as is illustrated herein with directional arrows A, B. The upper impact rib structure 20 and the lower impact rib structure 25 absorb an impact force such as a person falling thereon wherein the upper impact rib structure 20 and the lower impact rib structure 25 in conjunction with the curved portion 17 of the central support member 18 directs the impact load outwards towards edges of the upper portion 10. The aforementioned provides impact protection for items such as but not limited to rebar or other metal stakes.

The upper impact rib structure 20 is formed from a plurality of ribs 22 that are configured in a row formation wherein the plurality of ribs 22 are contiguously formed with the central support member 18 and extend upward therefrom to the upper surface 11. The upper impact rib structure 20 is aligned over the lower portion 15 as the lower portion 15 is configured to be operably coupled with an exposed construction element such as but not limited to an end of a metal rebar. It should be understood within the scope of the present invention that the upper impact rib structure 20 could be formed to cover a larger surface area of the upper portion 10. The lower impact rib structure 25 is also contiguously formed with the central support member 18 and comprises a plurality of ribs 28. The plurality of ribs 28 extend downward from the lower surface 19 of the central support member 18 and are perpendicular thereto. Both the upper impact rib structure 20 and the lower impact rib structure 25 are operable to deflect under impact and as such distribute a force load along the curved portion 17 central support member 18.

The upper portion 10 is operably supported to the lower portion 15 utilizing a plurality of support members 30. The support members 30 engage the lower portion 15 and the upper portion 10 and are operable to assist in the maintenance of the structure of the safety cover 100 during use thereof. It should be understood within the scope of the present invention that the safety cover could employ various quantities of support members 30. Furthermore, while the support members 30 are illustrated herein having a particular shape, it should be understood within the scope of the present invention that the support members 30 could be formed in alternate shapes and sizes.

The lower portion 15 includes a plurality of walls 40 forming a receiving channel 45 that is hollow so as to receive a portion of an exposed construction element thereinto. The lower portion 15 is contiguously formed with the upper portion 10 utilizing suitable durable techniques. The lower portion 15 extends downwards from the upper portion 10 and is of suitable length to accept in the receiving channel 45 a portion of an exposed construction element such as but not limited to an end of metal rebar. It should be understood within the scope of the present invention that the lower portion 15 could be provided in alternate lengths. Furthermore, while the lower portion 15 is illustrated herein having four walls 40 and being rectangular in shape, it is contemplated within the scope of the present invention that the lower portion 15 could be formed from a single wall or more than four walls and further be provided in alternate shapes.

Proximate the upper end 47 of the lower portion 15 within the receiving channel 45 is support collar 50. Support collar 50 is configured to mateable coupled with the end of a round metal rebar. The support collar 50 provides a frictional engagement with an end of a piece of metal rebar so as to ensure a stable connection with the safety cover 100. The support collar 50 is annular in shape having wall 51 that extends downward from the central support member 18. FIGS. 3 and 4 submitted herewith are cross-sectionals and as such the view of the support collar 50 is as illustrated wherein the bisections illustrated are centrally lengthwise across the lower portion 15 and centrally across the width of the lower portion 15.

The lower portion 15 includes apertures 8 formed in the walls 40. The apertures 8 provide an ability to secure the safety cover 100 to an object on which the safety cover is superposed. Furthermore, the apertures 8 provide an ability to secure identification tags or other similar articles to the safety cover 100. While the lower portion 15 is illustrated herein as having four apertures 8, it is contemplated within the scope of the present invention that the lower portion 15 could have more or less than four apertures 8. Additionally, it should be understood within the scope of the present invention that the apertures 8 could be alternate shapes and sizes.

Illustrated herein in FIGS. 5 through 8 is an alternate embodiment of the safety cover 100 wherein the embodiment illustrated therein is designed to be superposed an end of a flat metal stake. The safety cover 200 is similarly constructed to safety cover 100 having an upper portion 210 and a lower portion 215. The upper portion 210 includes impact layer 222 underneath the outer surface 209 of the upper portion 210. The impact layer 222 is similar in size to the upper portion 210 and is configured to inhibit a metal stake on which the safety cover 200 is superposed from penetrating the outer surface 209 of the upper portion 210. In a preferred embodiment the impact layer 222 is manufactured from metal or other similar material. It is contemplated within the scope of the present invention that the impact layer 222 could be either permanent or configured to be replaceable. The lower portion 215 includes formed in the receiving channel 245 a support collar 250. Support collar 250 extends downward into the receiving channel 245 and is rectangular in shape so as to mateably engage an end of a flat metal bar or stake. Ribs 228 are formed at the top of the receiving channel 245 and function as previously described herein wherein the ribs 228 will absorb the impact in order to minimize injury to an individual that has fallen onto the safety cover 200 while superposed a metal stake or bar. The additional elements of the support members 230, apertures 208 and walls 240 are identical as previously described herein for safety cover 100.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A safety cover configured to be superposed an end of a construction element so as to prevent injury to a worker upon accidental engagement therewith wherein the safety cover comprises:

a body, said body having an upper portion and a lower portion, said upper portion being planar in manner, said upper portion having an upper surface and a lower surface, said upper portion having a central support member formed therein, said central support member extending intermediate peripheral edges of the upper portion and being equal in size to the upper portion, said central support member having a curved portion wherein the curved portion is biased downwards towards the lower portion, said curved portion of said central member being centrally located on said upper portion, said lower portion being contiguously formed with said upper portion, said lower portion extending downward from said lower surface of said upper portion, said lower portion having at least one wall wherein the at least one wall is configured to define a receiving channel, said receiving channel being hollow having an opening distal to said upper portion, said receiving channel being configured to accommodate the end of the construction element therein;

a support collar, said support collar being formed in the receiving channel proximate to the upper portion, said support collar extending downward from the upper portion, said support collar being configured to mateably engage with the end of the construction element;

an upper impact rib structure, said upper impact rib structure contiguously formed with the curved portion of said central support member, said upper impact rib structure being comprised of a plurality of ribs, said plurality of ribs extending upward from said curved portion of said central support member.

2. The safety cover configured to be superposed the end of the construction element as recited in claim 1, and further including a second formation of a plurality of ribs, said second formation of plurality of ribs being contiguous with the curved portion of the central support member and extending downward therefrom into said lower portion.

3. The safety cover configured to be superposed the end of the construction element as recited in claim 2, wherein said support collar is annular in shape.

4. The safety cover configured to be superposed the end of the construction element as recited in claim 3, wherein said lower portion further includes at least one aperture formed in the at least one wall thereof.

5. A safety cover configured to be superposed an end of the construction element so as to prevent injury to a worker upon accidental engagement therewith wherein the safety cover comprises:

a body, said body having an upper portion and a lower portion, said upper portion being planar in manner, said upper portion having an upper surface and a lower surface, said lower portion being contiguously formed with said upper portion, said lower portion extending downward from said lower surface of said upper portion, said lower portion having at least one wall wherein the at least one wall is configured to define a receiving channel, said receiving channel being hollow having an opening distal to said upper portion, said receiving channel having an upper end and a lower end, said receiving channel configured to accommodate the end of a construction element therein;

an impact layer, said impact layer being present in the upper portion of the body, said impact layer being manufactured from a different material than said body, said impact layer being generally equal in size to said upper portion of said body;

a support collar, said support collar being formed in the receiving channel proximate to the upper portion, said support collar extending downward from the upper portion, said support collar being configured to mateably engage with the end of the construction element; and a plurality of ribs, said plurality of ribs being present at the upper end of the receiving channel, said plurality of ribs extending downward from the lower surface of said upper portion, said plurality of ribs configured to absorb impact force.

6. The safety cover configured to be superposed the end of the construction element as recited in claim 5, wherein said support collar is rectangular in shape.

7. The safety cover configured to be superposed the end of the construction element as recited in claim 6, wherein said lower portion further includes at least one aperture formed in the at least one wall thereof.

* * * * *